United States Patent [19]

Kearns

[11] Patent Number: 4,589,683

[45] Date of Patent: May 20, 1986

[54] SELF RECEIPTING CONTINUOUS STATIONERY FOR POINT-OF-SALE TERMINAL

[75] Inventor: Peter J. M. Kearns, Cardiff, Wales

[73] Assignee: Burroughs Corporation, Detroit, Mich.

[21] Appl. No.: 585,080

[22] Filed: Mar. 1, 1984

[30] Foreign Application Priority Data

Aug. 13, 1983 [GB] United Kingdom ..... 8321862

[51] Int. Cl.[4] ..... B41L 1/20

[52] U.S. Cl. ..... 282/11.5 A; 282/27 R

[58] Field of Search ..... 282/1 R, 2, 3 R, 4, 282/5, 9 R, 10, 11, 11.5 R, 11.5 A

[56] References Cited

U.S. PATENT DOCUMENTS

| | | | |
|---|---|---|---|
| 3,877,728 | 4/1975 | Herz | 282/11.5 A |
| 4,121,857 | 10/1978 | Halse | 282/11.5 A |
| 4,277,089 | 7/1981 | Lockhart | 282/27 R |
| 4,346,916 | 8/1982 | Shelton | 282/11.5 A |

FOREIGN PATENT DOCUMENTS

| | | |
|---|---|---|
| 799027 | 7/1958 | United Kingdom . |
| 962052 | 6/1964 | United Kingdom . |
| 1006662 | 10/1965 | United Kingdom . |
| 1154048 | 6/1969 | United Kingdom . |
| 1518779 | 7/1978 | United Kingdom . |
| 1555498 | 11/1979 | United Kingdom . |
| 2092954 | 8/1982 | United Kingdom . |

*Primary Examiner*—Paul A. Bell

*Attorney, Agent, or Firm*—Kevin R. Peterson

[57] ABSTRACT

In a point-of-sale terminal wherein continuous stationery is fed from a fanfold stack by friction drive to be printed, a receipt portion removed, and the residual continuous record stored in a record, fanfold stack, the stationery comprises a base ply having a removable ply affixed thereon by a pair of glue lines outboard of a pair of longitudinal perforated lines for removing an edge strip having sprocket hole lines and inboard of the sprocket holes. Transverse separation lines are provided near the folds in the base ply. The separation lines can be perforated lines, cut right through, or chemically weakened in the removable ply. The second illustrated embodiment of the invention discloses a second transverse separation line spaced away from the first transverse separation line and the part of the removable ply intermediate therebetween affixed to the base ply to prevent the tearing of one receipt from initiating the tearing of a receipt in a following transaction record. Where the transverse separation lines are completely through-penetrative of the removable ply initiation of the tearing of another receipt portion by the tearing of a first is similarly prevented. The continuous stationery disclosed is resistant to ply separation by over-vigorous friction drive between opposed rollers.

20 Claims, 11 Drawing Figures

SELF RECEIPTING CONTINUOUS STATIONERY FOR POINT-OF-SALE TERMINAL

BACKGROUND TO THE INVENTION

1. Field of the Invention

The present invention relates to continuous stationery for use in computer-controlled printing apparatus and particularly relates to continuous stationery for use in a point-of-sale terminal wherein a permanent record of a transaction is made for retention by the user and a copy, by way of a receipt, is provided for the customer.

2. The Prior Art

It is known to use continuous stationery in a point-of-sale terminal. Prior art stationery consists in a back ply and a front ply held together by paper staples. Sprocket holes are through-penetrative of both front and back plies and are used for aligning the continuous stationery in the point-of-sale terminal. The point-of-sale terminal includes a printer for writing on the continuous stationery. The continuous stationery is drawn from a first fanfold pile, printed upon by the point-of-sale terminal, the top ply detached and handed to the customer by way of a receipt, and the back ply refolded and kept as a continuous record.

Because of the compactness of construction of a point-of-sale terminal and the requirement for the provision of data communication and data processing elements therein, the construction of the printing apparatus in a point-of-sale terminal differs in some material aspects from the construction to be found in a normal computer-driven printer. Firstly, in order to minimize the volume of the point-of-sale terminal, the pin roller assembly for aligning the continuous stationery via the sprocket holes is provided remotely from the print head and before the print anvil whereas in a normal computer printer the pin roller assembly is provided proximate to the print head and anvil. Secondly, it is the custom in point-of-sale terminals to drive the continuous stationery by means of friction roller bearings. The continuous stationery is gripped between two rollers, at least one of which is driven, and fed through the point-of-sale terminal.

Several problems exist in using conventional, continuous stationery in a point-of-sale terminal. Because of the required exit orientation of the printed stationery from the point-of-sale terminal and the remoteness of the pin roller assembly from the printing head, the continuous stationery passes over the pin roller assembly in what, in other equipment, would be an upside down manner. The front ply being affixed to the back ply by paper staples, and the pin roller assembly being provided with sprocket covers, the protruding parts of the paper staples can jam in the sprocket cover and bring the whole apparatus to a halt, requiring the rethreading of the continuous stationery.

The pair of friction rollers driving the continuous stationery through the point-of-sale terminal, because of the weakness of paper staples, can cause the front ply to shear from the back ply thereby causing a risk of jamming a misregistration in the printer.

The form, having been printed, requires to have the front ply removed from the back ply in order that the customer may receive his receipt. Once again, because of the weakness of paper staples, there is a good chance that the paper staples will give way before the perforate line in the front ply running along the length of the continuous stationery. This results in the customer being handed a receipt complete with edge portions and sprocket holes. This is not aesthetically pleasing. Alternatively, the point-of-sale operator may be required to strip the edge portions with the sprocket holes from the customers receipt. In either case the uncertainty of the detachment of the receipt in the front ply is an undesirable feature.

Further, the perforate lines between adjacent forms in the front ply of the continuous stationery create a risk that in tearing off a receipt for a customer the user of the point-of-sale terminal may begin to tear off the portion of the front ply which would be the receipt for a customer on a following form.

It is therefore desirable to provide continuous stationery for use in a point-of-sale terminal having a pin roller assembly whereover the stationery passes in an inverted manner, wherein the stationery is driven by friction rollers, wherein the receipt portion of the front ply is assured of removal free of edge portions and sprocket holes, and wherein the portion of the front ply in one transaction form which is detached by way of receipt is assured of detachment without commencing the detachment of the corresponding portion in a following transaction form.

SUMMARY OF THE INVENTION

The present invention consists in continuous, sprocket-aligned, friction driven, fanfold self copy printer stationery for maintaining a transaction record and for providing an automatic, detachable customer receipt in a point-of-sale terminal, said stationery comprising: a base ply comprising regularly spaced transverse fold lines for defining the distance between each successive pair thereof as a transaction form, a pair of lines of sprocket holes proximate to the edges of said base ply, a detachable ply comprising first and second transverse separation lines in each transaction record proximate to said fold lines and further comprising a pair of longitudinal lines of weakening inboard of said two lines of sprocket holes, and a pair of glue lines between said line of sprocket holes and said longitudinal lines of weakening on each side of said base ply for affixing said detachable ply to said base ply, where a removable part of said detachable ply is removable from said base ply in each transaction form by the opening of a first of said pair of transverse separation lines, the tearing towards the second of said pair of transverse separation lines of said pair of longitudinal lines of weakening, and the transverse tearing or opening of the second part of said pair of transverse separation lines, the part of the detachable ply, removed from said each transaction form being providable as a customer receipt.

BRIEF DESCRIPTION OF THE PREFERRED EMBODIMENTS

In a first preferred embodiment of the present invention a base ply has a detachable ply affixed thereover. Sprocket holes are provided in the base ply in two longitudinal lines one proximate to either side of the continuous stationery. The detachable ply preferably extends over the two lines of sprocket holes in which case the detachable ply preferably comprises correspondingly adjacent sprocket holes. The detachable ply comprises first and second longitudinal lines of weakening inboard of the lines of the sprocket holes. The longitudinal lines of weakening preferably, but do not necessarily, also penetrate the base ply, in which case the longitudinal lines of weakening can be used for separating the edge portions of the continuous stationery bearing the sprocket holes from the continuous stationery.

The continuous stationery comprises first and second transverse separation and fold lines. The transverse separation and fold lines allow division of the detachable ply and folding of the base ply. The transverse separation and fold lines preferably also allow division of the base play into individual transaction forms, a transaction form being defined as that part of the continuous stationery between successive ones of the separation and fold lines.

The back ply has deposited thereon first and second glue lines, one between each of the lines of sprocket holes and the longitudinal lines of weakening. The glue lines affix the detachable ply to the base ply. The glue lines are preferably continuous.

In use, the transaction form having been printed in a point-of-sale terminal, the printed transaction form is preferably fed from the point-of-sale terminal to lie on its top. The user preferably holds down the continuous stationery by pressing on an earlier-printed transaction form, breaks apart and lifts a first one of the pair of transverse separation lines, pulls back the receipt portion of the detachable ply by tearing the longitudinal lines of weakening, and thereafter tears the second transverse separation line in a transverse manner to detach the customer receipt.

In a second preferred embodiment, all is as in the first preferred embodiment save that the first transverse separation line is an open slit for the easy insertion therein of the digits by the point-of-sale operator and that the second transverse separation line is spaced away from the fold line at its end of the transaction form, the portion of the detachable ply intermediate between the second transverse separation line and the fold line at its respective end of the transaction form being affixed at one or more points to the base ply in order to render the transverse tearing of the second transverse separation line proof against the commencing of tearing of the receipt portion of a following transaction form.

BRIEF DESCRIPTION OF THE DRAWINGS

The invention is further explained, by way of example, by the following description in conjunction with the appended drawings in which.

DETAILED DESCRIPTION OF THE PREFERRED EMBODIMENTS

Figure 1:
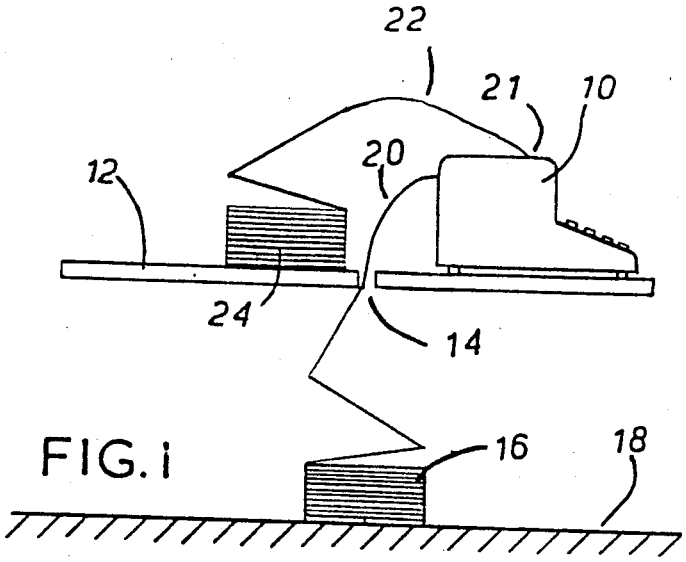
FIG. 1 is illustrative of the lay-out of a point-of-sale terminal wherein the present invention is to be used.

FIG. 1 shows the environment wherein the present invention is to be used. The point-of-sale terminal 10 rests upon a counter top 12 having a stationery feed slot 14 provided therein. A fanfold stationery feed pile 16 rests upon the floor 18 beneath the counter top 12 and provides an unprinted stationery feed 20 into the rear of the point-of-sale terminal 10. The point-of-sale terminal is provided with a printer output slot 21 wherefrom outgoing printed stationery 22 is fed having had records of a transaction printed thereon. A portion of the outgoing printed stationery 22 is detached and handed to the customer by way of receipt. The remainder of the outgoing printed stationery 22 is stored in a printed stationery pile 24 resting upon the counter top 12 to provide a permanent record of the transactions entered into at the point-of-sale terminal 10 for accountancy, checking and data integrity preserving purposes.

Figure 2:
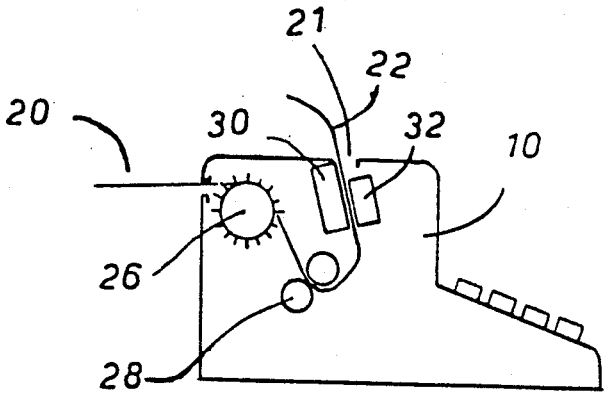
FIG. 2 is a cross-sectional view of the point-of-sale terminal of FIG. 1, again being illustrative of the environment wherein the present invention is to be used.

FIG. 2 shows a schematic cross-sectional view of the point-of-sale terminal 10 of FIG. 1. The unprinted stationery feed 20 first passes over a pin roller assembly 26. Having passed over the pin roller assembly 26 the unprinted stationery feed 20 passes between first and second friction drive rollers 28. The unprinted stationery feed 20 is moved through the point-of-sale terminal by one of the pair of friction drive rollers 28 being driven and pushing the unprinted stationery feed 20 against the other of the pair of friction drive rollers 28.

Having passed between the friction drive rollers 28 the unprinted stationery 20 enters a printing area wherein it passes over a print anvil 30 and behind a printing head 32. Having been printed, the feed stationery 20 becomes printed stationery 22 and passes out of the point-of-sale terminal via the printer output slot 21. The printer can be one of many kinds which produce print by causing an impact upon the stationery 20. For example, the printer can be a golf ball, daisy wheel or dot matrix printer, but this is not restrictive.

The purpose of the pin roller assembly 26 is to assure the alignment of the unprinted stationery feed 20 within the point-of-sale terminal. To this end the unprinted stationery feed 20 is provided with rows of sprocket holes down its edges and the pin roller assembly comprises a roller with matching sprocket pins at either end. It would be normal in most computer-driven printers to provide the pin roller assembly 26 in the vicinity of the printer 30,32. However, for reasons of cost and compactness, it is customary in a point-of-sale terminal to keep the pin roller assembly 26 remote from the printer. In particular, it is used to align the incoming stationery feed 20 because of the uncertainty of the entry angle from the fanfold stationery feed pile 16. Similarly, whilst in normal computer-driven printing equipment it would be the pin roller assembly 26 which is driven to move the unprinted stationery 20 through the printer, in the point-of-sale terminal shown, movement of the paper is achieved using the pair of friction rollers 28 once again for reasons of economy and compactness.

Figure 3:
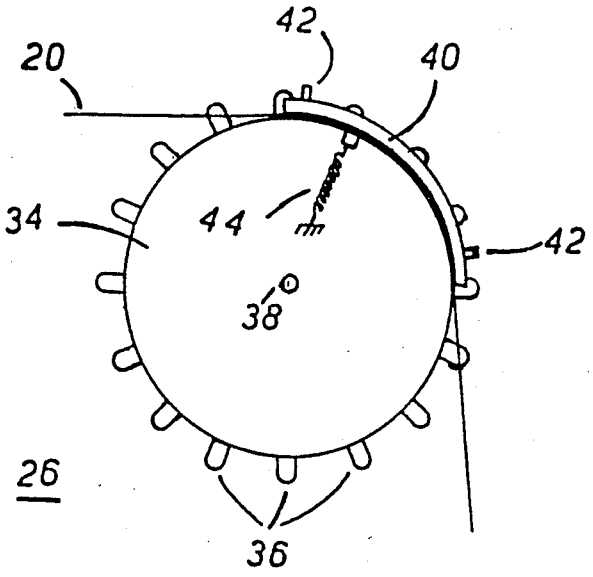
FIG. 3 is a detailed side elevation of the pin roller assembly shown in FIG. 2.

FIG. 3 shows a side elevation of the pin roller assembly 26 wherein the present invention can be employed. The pin roller assembly 26 comprises a pin roller 34 whereon are provided a plurality of circumferentially-equispaced sprocket pins 36. The sprocket pins 36 are provided at either end of the pin roller 34. The pin roller 34 rotates about an axle 38 in a passive manner, rotation being induced by the movement of the unprinted stationery 20. A two-part sprocket cover 40, whose two parts are held together by connecting bridges 42 is held against the pin roller 34 by a spring tension assembly 44.

Figure 4:
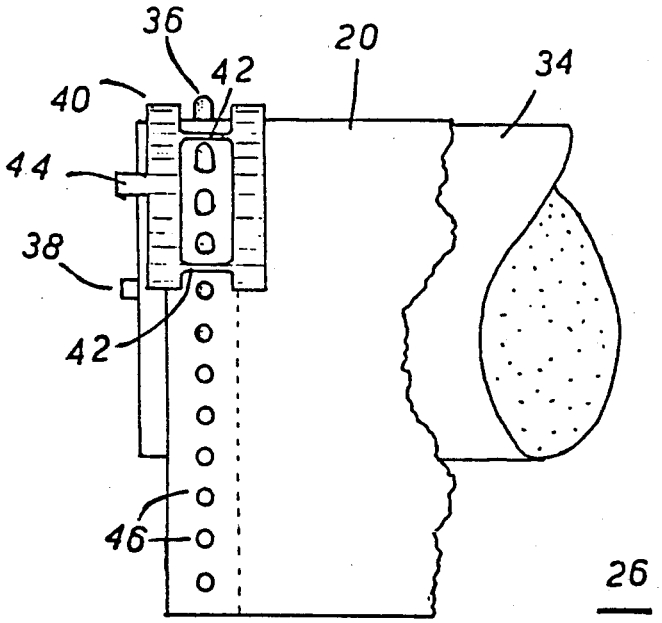
FIG. 4 is a front elevation of the pin roller assembly shown in FIG. 3.

FIG. 4 shows a front elevation of a portion of the pin roller assembly 26 otherwise shown in FIG. 3. The unprinted stationery 20 passes over the pin roller 34 and is provided with rows of sprocket holes 46 down either edge. The sprocket holes 46 mate with the sprocket pins 36 on either end of the pin roller 34 for the sprocket pins 36 to maintain the unprinted stationery 20 in alignment over the pin roller assembly 26. In order to prevent the unprinted stationery from coming off the sprocket pins 36, the sprocket cover 40 urges the unprinted stationery 20 against the pin roller 34. The sprocket cover 40 is in two parts, one on either side of the row of sprocket pins 36. The two parts of the sprocket cover 40 are connected by one or more connecting bridges 42 which are arched sufficiently highly for the sprocket pins 36 to pass unimpeded therebeneath.

Figure 5:
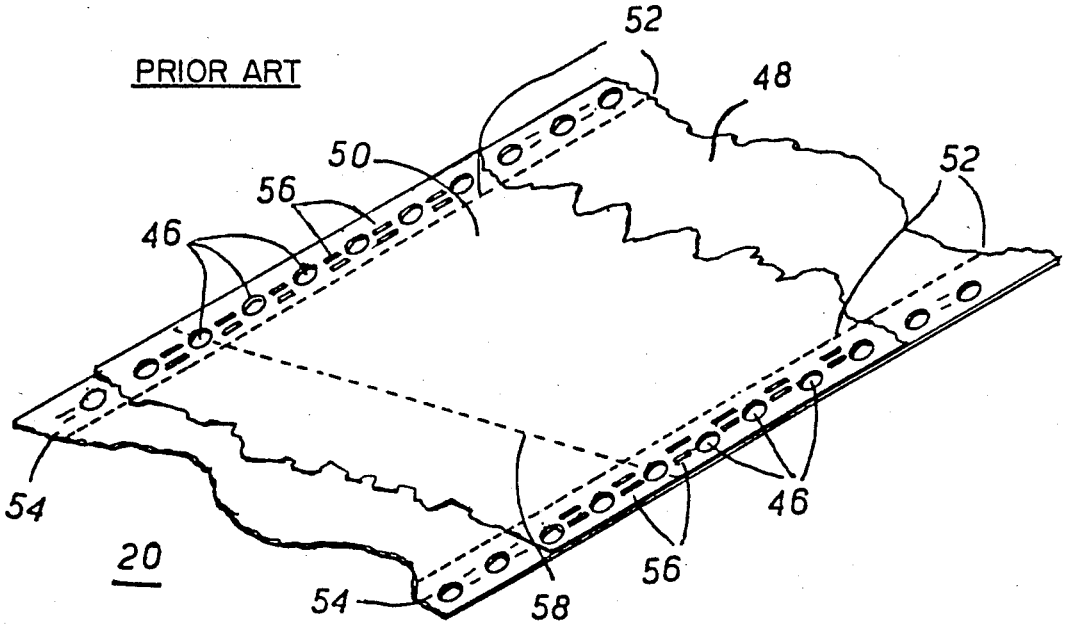
FIG. 5 illustrates the prior art continuous stationery used in the point-of-sale equipment illustrated in FIGS. 1 to 4.

FIG. 5 shows prior art stationery used in the equipment shown in FIGS. 1–4. The unprinted stationery 20 comprises a back ply 48 whereon a front ply 50 is affixed. The front ply 50 is of the same width as the back ply 48 and both are provided with the sprocket holes 46. Longitudinal perforation lines 52 are provided coincidently in both the back ply 48 and the front ply 50 whereby an edge strip 54 may be removed from the stationery 20 to remove the rows of sprocket holes 46. The front ply 50 is attached to the back ply 48 by means of paper staples 56 in the edge strip 54. The paper staples are here shown as being provided one between each pair of the sprocket holes 46. This is not necessarily the case and all that is required is that one or more paper staples is provided in the vicinity of the row of sprocket holes 46.

The stationery 20 is provided with regularly-spaced composite transverse perforation and fold lines 58 allowing the fanfolding of the stationery 20 and permitting the portion of the front ply 50 between successive ones thereof to be removed by tearing the longitudinal perforation lines 52 as a customer receipt.

Figure 6:
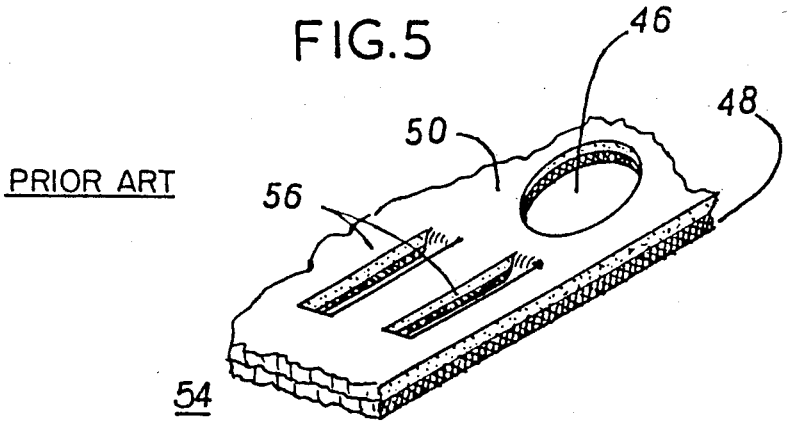
FIG. 6 shows a detail of the paper staples used in the prior art stationery of FIG. 5.

FIG. 6 shows a detail of the paper staples 56 of FIG. 5. The paper staples 56 are formed by making one or more pairs of truncated longitudinal incissions right through both the back ply 48 and the front ply 50 and by pushing through the resultant loop between the parallel incissions from the front ply 50 so that the loop protrudes beneath the back ply 48. The paper staple therefore adds to the thickness of the stationery 20.

With reference to FIGS. 2, 3, 4, 5 and 6, whereas the paper staple 56 is widely used in computer stationery for holding one or more plies 48, 50 of paper together and the pin roller assembly 26 is widely used for the alignment of computer stationery, because of the requirement to feed the stationery 20 in and out of the point-of-sale terminal 10 in an orderly manner appropriate to a point-of-sale, the stationery 20 passes over the pin roller assembly 26 in what would otherwise be regarded as an upside down manner. The loops of the paper staples 56 instead of being pressed against the pin roller 34 in fact protrude outwardly from the pin roller 34 and stand a very high chance of becoming trapped in the sprocket cover 40. This has the disastrous effect of jamming the stationery path in the point-of-sale terminal which then must be cleared with consequent cost penalties.

The paper staple 56 displays more strength in some directions than others. It is therefore most resistant to transverse movement between the plies 48,50 and less resistant to longitudinal displacement between the plies 48,50. Similarly, the paper staple 56 can display even less resistance to the vertical tearing apart of the plies.

When the prior art stationery shown in FIG. 5 passes between the pair of friction drive rollers 28 longitudinal stress is imparted which tends to tear the paper staples 56 and to cause the front ply 50 to be slid and tented in a longitudinal direction relative to the back ply 48. The tenting can cause a jam in the printer 30, 32 and, at the very least, misalignment between the front ply 50 and the back ply 48 will cause misprinting of the record in one or the other.

When it is attempted to remove the receipt portion of the front ply 50 from the stationery 20, the paper staples 56 are subjected to an inward and upward stress. Paper staples 56 do not very well resist upward stress and the result can well be the disintegration of the paper staples 56 rather than the intended tearing of the longitudinal perforation lines 52. Thus, by this erroneous tearing, the customer is provided with a receipt which is aesthetically displeasing in that the portion of the edge strips 54 on the front ply 50 are still attached to the front ply 50. The point-of-sale attendant may be required to remove the adhering edge strips 54 which adds to the time and cost of the transaction.

Even if the edge strip 52 correctly tears there is no guarantee that the transverse perforations in the top ply 50 in the next subsequent portion of the top ply 50 in the transverse perforation and fold line 58 following will tear before the longitudinal perforation lines 52 in the subsequent receipt portion of the front ply 50 also begin to tear. Thus, there can be difficulty in ensuring that the receipt portion of the top ply 50 which lies between successive pairs of transverse perforation and fold lines 58 and between the pair of longitudinal perforation lines 52 comes away cleanly and separately. In particular, if portions of the edge strip 54 are missing from some of the records in the printed stationery pile 24 shown in FIG. 1, the stability and managability of the printed stationery pile 24 can be impaired.

Figure 7:
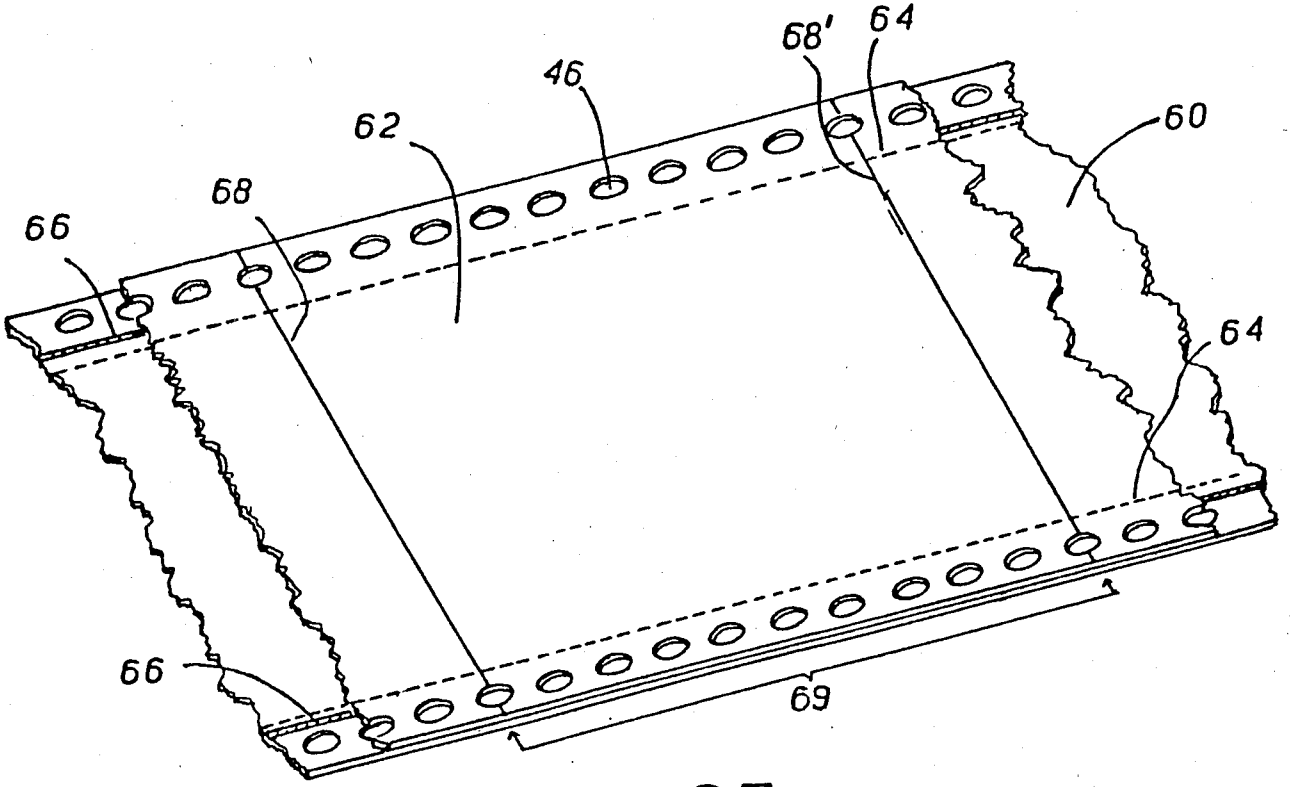
FIG. 7 shows the first preferred embodiment of the continuous stationery of the present invention.

FIG. 7 shows the first preferred embodiment of the present invention. A base ply 60 has a detachable ply 62 thereover. In the preferred embodiment shown in FIG. 7 the detachable ply 62 is the same width as the base ply 60. The sprocket holes 46 are provided in both the detachable ply 62 and the base ply 60. As will later become apparent, there is no necessity for the detachable ply 62 to be the same width as the base ply 60. In this embodiment sprocket holes 46 in the base and detachable plies 60,62 are employed, as is well known in the art, in a collating machine for aligning the detachable ply 62 and the base ply 60 one over the other. Those skilled in the art will be aware of different manners of assembling the detachable ply over the base ply wherein the use of aligned sprocket or collating holes is not required.

The top ply 62 is provided with a pair of longitudinal lines of weakening 64 proximate to the edges thereof. The longitudinal lines of weakening are required only to be through-penetrative of the detachable ply 62. For the working of the present invention there is no requirement for the longitudinal lines of weakening 64 to be through-penetrative of the base ply 60. In the preferred embodiment of the present invention shown in FIG. 7, the longitudinal lines of weakening are also through-penetrative of the base ply 60. This is a matter of convenience only for allowing the edge strip of sprocket holes 46 to be detached from the base ply 60 is so desired. The longitudinal lines of weakening 64 are lines of perforations. This is a preferred manner of construction of the longitudinal lines of weakening 64. Those skilled in the art will be aware that any method of creating a localized weakness in the detachable ply 62 will serve to create the longitudinal lines of weakening. Other methods envisaged for the creation of the longitudinal lines of weakening 64 include part way cutting through the ply 62, 60 and the printing of chemicals onto the ply 60, 62 to create local partial alteration of structure.

Longitudinal glue lines 66 are laid down on the base ply 60 and hold the detachable ply 62 thereon. The longitudinal glue lines 66 are provided one on either side of the base ply 60 and are situated inboard of the lines of sprocket holes 46 and outboard of the longitudinal lines of weakening 64 to rest therebetween. The longitudinal glue lines can be continuous or can comprise a plurality of longitudinally spaced glue areas. All that is required is that the force required to detach the detachable ply 62 from the longitudinal glue lines 66 is greater than the force required to break the longitudinal lines of weakening 64.

A first transverse separation and fold line 68 and a second transverse separation and fold line **68*a* define, in the longitudinal space therebetween, a transaction form 69. A record to be retained by the user of the point-of-sale terminal 10 is copied in consequence of the impacting of the printer 30,32 on the detachable ply 62 on the base ply 60. The printed detachable ply 62 is the customer receipt. In the embodiment of the present invention shown in FIG. 7 and subsequently in FIG. 8 the detachable ply, 62' and the base ply, 60' together form a self-copying set. Those skilled in the art will be aware of other manners in which a copy can be made. In a self-copying set, copies are produced in consequence of chemical reaction between mating surface coatings within the stationery. In the present invention a base ply, 60' can be employed which is self-copying, that is, which is impregnated with chemicals such as encapsulated dye which produce a copy when struck. Similarly a carbon coating can be provided on the back of the detachable ply, 62' for making a copy in some or all of the area of the base ply 60' in the transaction form 69'**.

The first transverse separation and fold line 68 is through-penetrative of the detachable ply and marks the site of a folding of the base ply 60 for making the fanfold stacks 16,24. It is not required that the first transverse separation and fold line and the second transverse separation and fold line **68*a* should allow separation of portions of the base ply 60. In the embodiment shown in FIG. 7, the first and second transverse separation and fold lines 68, 68*a* are perforated lines allowing both the detachable ply 62 and the base 60 to be divided. In order that the longitudinal lines of weakening 64 and the first and second transverse separation lines 68, 68*a* should properly work in these circumstances it is required that the corresponding separation or weakended lines 64, 68, 68*a* in the base ply 60 should split at a greater force than the separation of weakened lines 68, 68*a*, 64 in the detachable ply. For preference, this is achieved by arranging that the base ply 60 is of a more robust paper than the detachable ply 62. However, in the present invention, it is possible to arrange that the nature of the perforations or weakening are different between the base ply 60 and the detachable ply 62. In the case of perforations, it is possible to arrange that the splits are fewer and/or shorter in the base ply 60 than the detachable ply 62**.

In an embodiment not separately illustrated, the first and second transverse separation lines 68, **68*a* are not perforated, but are completely cut through in the detachable ply. In this instance, the separation lines 68, 68*a* do not extend right to the edges of the detachable ply, but only to the longitudinal lines of weakening 64** thereon.

As before stated, there is no requirement for the detachable ply 62 to extend as far as the edges of the base ply 60. All that is required is that the detachable ply 62 extends sufficiently far to cover the longitudinal glue lines 66.

In those embodiments where the transverse separation and fold lines 68, **68*a* are also through-penetrative of the base ply 60 this is purely a matter of preference to allow individual records to be removed from the printed stationery pile 24 for later examination by the tearing out of an individual record or copy transaction form 69 from the pile 24**.

Figure 8:
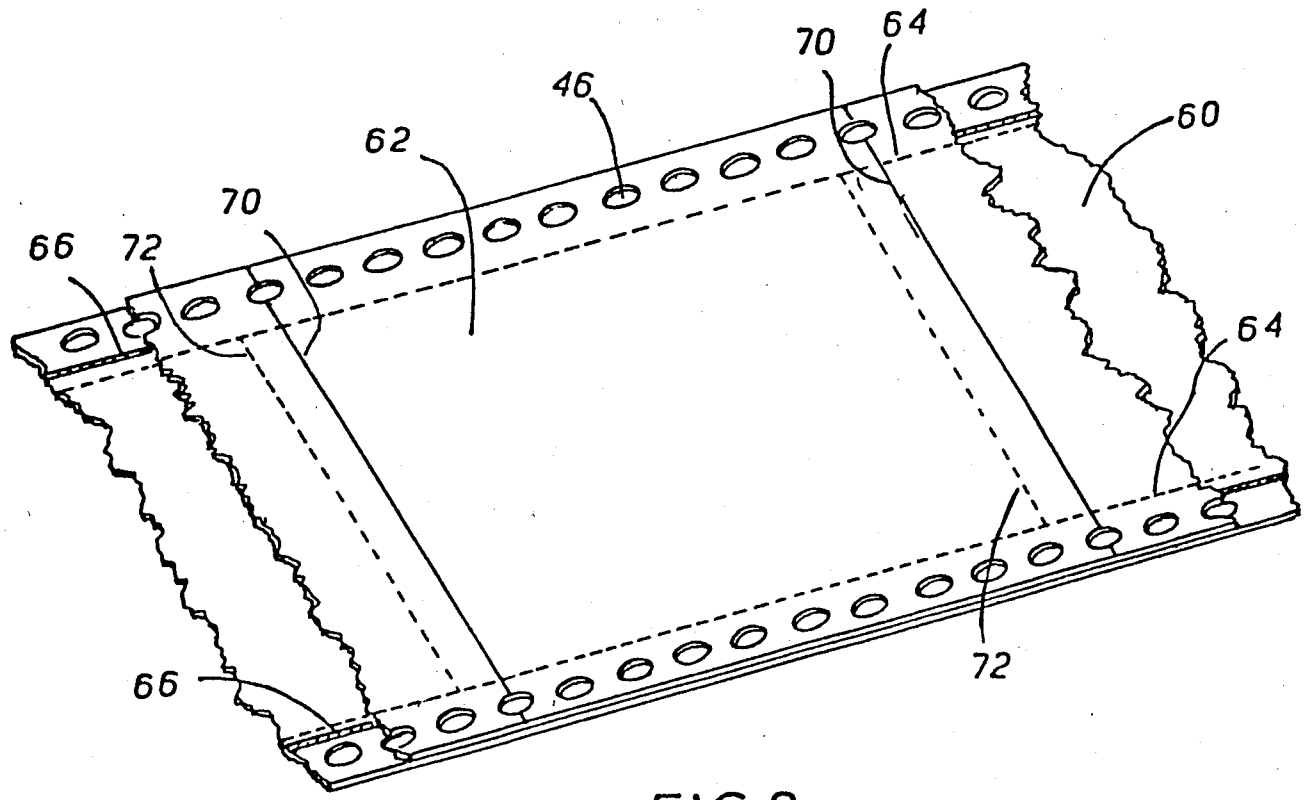
FIG. 8 shows the second preferred embodiment of the continuous stationery of the present invention.

FIG. 8 shows a second embodiment of the present invention. All similarly numbered items are the same as in the preferred embodiment shown in FIG. 7 and as described in variational embodiments thereover. Instead of the transverse separation and fold lines 68, **68*a* of FIG. 7 the transaction form 69' is defined by sequential cross-slit and fold lines 70*a*. In the cross-slit and fold lines the detachable ply 62, is completely through-penetrated between the longitudinal lines of weakening. The base ply 60, can be perforated thereon but does not require to be so. The cross-slit and fold lines, 70*a* allow for the fanfolding of the stationery. Just adjacent to the cross-slit and fold lines 70 here is provided in the detachable ply 62' a modified cross-perforation 72. The modified cross-perforation 72 is shown for preference and surety of operation as extending only between the longitudinal lines of weakening 64'. It is to be appreciated that the modified second cross-perforation 72 can extend right to the edge of the detachable ply. The modified secondary cross-perforation 72 is a perforated line and allows separation of the detachable ply 62' along its length only upon application of force to the detachable ply 62'. That portion of the detachable ply 62' which lies between the secondary cross-perforation 72 and the cross-slit and fold line 70 is attached to the base ply 60' by means of one or more glue areas, not explicitely shown but whose method of application will be apparent. The one or more areas of glue hold that part of the detachable ply 62' between the modified second cross-perforation 72 and the cross-slit and fold line 70 against the tearing force required to break the modified secondary cross-perforation 72. The fact of the existence of the cross-slit line 70 and of the glue area or areas on the part of the detachable ply 62' intermediate between the modified second cross-perforation 72 and the cross-slit 70 means that no tearing force is transferred to the receipt portion of the detachable ply in a subsequent transaction form. The detachment of one receipt portion of the detachable ply 62' in one transaction form 69' lying between the cross-slit and fold line 70, the modified second cross-perforation 72, and the longitudinal lines of weakening 64' does not effect or commence the detachment of a receipt portion in a following transaction form 69'**.

Figure 9:
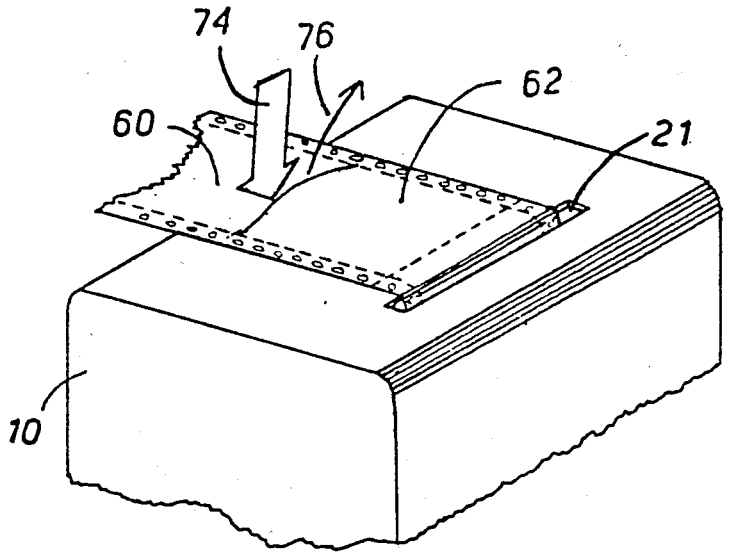
FIG. 9 shows the first stage of detaching a receipt from the continuous stationery of FIGS. 7 and 8.
Figure 10:
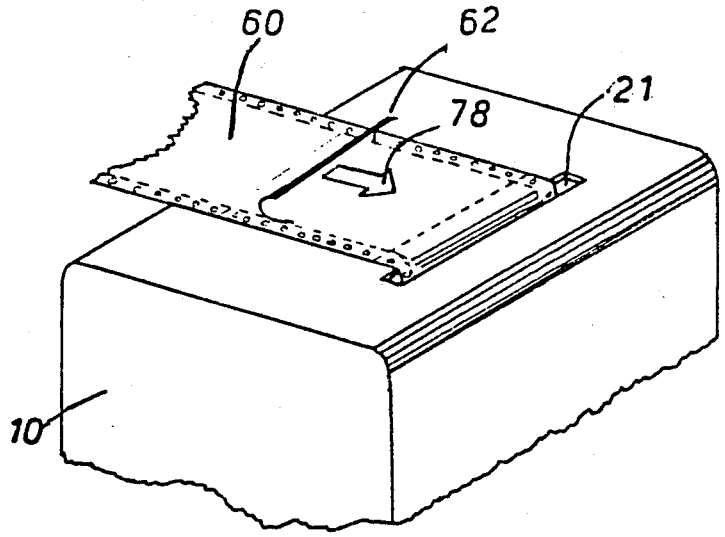
FIG. 10 shows the second stage of detaching a receipt from the continuous stationery of FIGS. 7 and 8.
Figure 11:
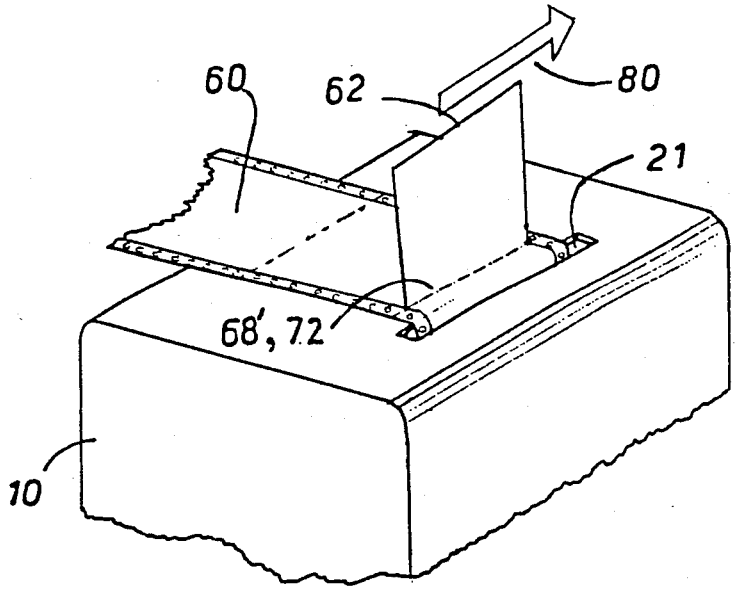
FIG. 11 shows the third and final stage of detaching a receipt from the continuous stationery of FIGS. 7 and 8.

FIGS. 9 to 11 apply equally to all embodiments of the invention hereinbefore described.

FIG. 9 shows the first stage of the detachment of a receipt portion of the detachable ply, 62' from the stationery. The printed transaction form, 69' having exited from the printer output slot 21 lies on top of the cover of the point-of-sale terminal. The cover of the point-of-sale terminal 10 is deliberately deeper than the length of one transaction form, 69'. The operator firstly pushes down on the base ply, 60' of a previously-printed transaction form as indicated by the first arrow 74. The operator then inserts one or more digits to begin the lifting of the receipt portion of the detachable ply, 62'. In the case of the preferred embodiment shown in FIG. 7 this is achieved by breaking the perforations in the first transverse separation line 68. In the embodiment, not specifically shown, improving over FIG. 7 where the first and second transverse separation lines 68, 68' are completely through-penetrative of the detachable ply, it is merely necessary to lift the edge of the first transverse separation line 68. In the embodiment of the present invention shown in FIG. 8 it is merely necessary to lift the leading edge of the cross-slit 70. Which ever method is employed, the leading edge is grasped and pulled upwards and towards the operator as indicated by the second arrow 76.

FIG. 10 shows the second stage of the removal of the receipt portion of the detachable ply, 62'. The operator continues to push down on the previous transaction form, 69' base ply, 60' as shown in FIG. 9 by the first arrow 74. Having pulled on the leading edge of the receipt as indicated by the second arrow 76 the longitudinal lines of weakening 64, 64' begin to separate. As soon as this separation commences, the operator begins to pull on the leading edge of the receipt portion of the detachable ply, 62' as indicated by the third arrow 78. The pull is in a more horizontal direction than that indicated by the second arrow 76 but is not completely horizontal.

FIG. 11 shows the last stage of the removal of a receipt portion of the detachable ply, 62'. In the embodiment shown in FIG. 7 the action of FIG. 10 is continued until the receipt portion of the detachable ply 62 severs the longitudinal lines of weakening up to the second transverse separation line **68*a*. In the embodiment shown in FIG. 8 the action of FIG. 10 is continued until the receipt portion of the detachable ply 62' severs the longitudinal lines of weakening up to the modified second cross-perforation 72. The receipt portion of the detachable ply 62' is then transversely torn as indicated by the fourth arrow 80 to sever the second transverse separation line 70*a* or the secondary cross-perforation 72 to completely detach the receipt portion of the detachable ply 62 which can then be handed to the customer free of any edge strips 54 bearing sprocket holes 46**.

The final stage shown in FIG. 11 is not required in the embodiment, described in association with FIG. 7 but not specifically separately shown where the first and second transverse scission lines **68, 68*a* are completely through-penetrative of the detachable ply 62. In this instance it is merely necessary to continue the action of FIG. 10 until the longitudinal lines of weakening 64 are divided up to the second transverse separation line 68'. The receipt portion of the detachable ply 62 is then automatically separated from the base ply 60 without there being a requirement for the tearing action illustrated in FIG. 11**.

In the embodiment shown in FIG. 8 and in the described embodiment wherein the first and second transverse separation lines **68, 68*a* of FIG. 7 are completely through-penetrative of the detachable ply the possibility of the removal of a receipt from one transaction form 69 commencing the removal of a receipt from a subsequent transaction form 69'** is completely eliminated.

Those skilled in the art will now be aware of different particular manners for implementing the present invention. The invention may be further embodied by taking any or all of the features hereinbefore described singly or in combination.

What I claim is:

1. Continuous, sprocket-aligned, friction driven fanfold self-copy printer stationery for maintaining a transaction record and for providing an automatic, detachable customer receipt in a point-of-sale terminal, said stationery comprising:

a base ply comprising regularly spaced transverse fold lines for defining the distance between each successive pair thereof as a transaction form;

a pair of lines of sprocket holes proximate to the edges of said base ply;

a detachable ply comprising first and second transverse separation lines in each transaction record proximate to said fold lines and further comprising a pair of longitudinal lines of weakening inboard of said two lines of sprocket holes; and a pair of glue lines between said line of sprocket holes and said longitudinal weakening line on each side of said detachable ply for affixing said detachable ply to said base ply;

where a removable part of said detachable ply is removable from said base ply in each transaction form by the opening of a first of said pair of transverse separation lines, the tearing towards the second of said pair of transverse separation lines of said pair of longitudinal lines of weakening and the transverse tearing of the second of said pair of transverse separation lines, the part of the detachable ply, removed from each said transaction form being providable as a customer receipt;

said second one of said pair of transverse separation lines being spaced from the fold line at its respective end of said each transaction form, the part of said detachable ply intermediate between said second one of said pair of said transverse separation lines and said fold line at said respective end of said each transaction form of said second transverse separation line being affixed at one or more points to said base ply to support the tearing of said second transverse separation line.

2. Stationery according to claim 1, wherein said second transverse separation line and said pair of longitudinal lines of weakening lines are perforate.

3. Stationery according to claim 2, wherein said detachable ply further comprises a pair of rows of sprocket holes for adjacent superposition over the corresponding sprocket holes in said base ply, the portion of said detachable ply wherein said sprocket holes are provided remaining affixed to said base ply by said glue lines when said removable part of said detachable ply is removed.

4. Stationery according to claim 3, wherein said first transverse separation line is completely through-penetrative of said detachable ply at least between said longitudinal lines of weakening.

5. Stationary according to claim 2, wherein said first transverse separation line is completely through-penetrative of said detachable ply at least between said longitudinal lines of weakness.

6. Stationery according to claim 1, wherein said second transverse separation line and said pair of longitudinal lines of weakening are perforate lines.

7. Stationery according to claim 6, wherein said detachable ply further comprises a pair of rows of sprocket holes for adjacent superposition over the corresponding sprocket holes in said base ply, the portion of said detachable ply wherein said sprocket holes are provided remaining affixed to said base ply by said glue lines when said removable part of said detachable ply is removed.

8. Stationery according to claim 6, wherein said first transverse scission line is completely through-penetrative of said detachable ply at least between said longitudinal lines of weakening.

9. Stationery according to claim 1, wherein said detachable ply further comprises a pair of rows of spocket holes for adjacent superposition over the corresponding sprocket holes in said base ply, the portion of said detachable ply wherein said sprocket holes are provided remaining affixed to said base ply by said glue lines when said removable part of said detachable ply is removed.

10. Stationery according to claim 9, wherein said first transverse separation line is completely through-penetrative of said detachable ply at least between said longitudinal lines of weakening.

11. Stationery according to claim 1, wherein said pair of longitudinal lines of weakening are also provided on said base ply, said base ply being stronger than said detachable ply for the pair of longitudinal lines of weakening in said detachable ply to part in preference to the pair of longitudinal lines of weakening in said base ply.

12. Stationery according to claim 3, wherein said second transverse separation line and said pair of longitudinal separation lines of weakening are perforate lines.

13. Stationery according to claim 11, wherein said detachable ply further comprises a pair of rows of sprocket holes for adjacent superposition over the corresponding sprocket holes in said base ply, the portion of said detachable ply wherein said sprocket holes are provided remaining affixed to said base ply by said glue lines when said removable part of said detachable ply is removed.

14. Stationery according to claim 9, wherein said first transverse separation line is completely through-penetrative of said detachable ply at least between said longitudinal lines of weakening.

15. Stationery according to claim 11, wherein said first transverse separation line is completely through-penetrative of said detachable ply at least between said longitudinal lines of weakness.

16. Stationery according to claim 11, wherein said first transverse separation line is a perforate line.

17. Stationery according to claim 1, wherein said first transverse separation line is completely through-penetrative of said detachable ply at least between said longitudinal of lines weakening.

18. Stationery according to claim 1, wherein said first transverse separation line is completely through-penetrative of said detachable ply at least between said longitudinal lines of weakening.

19. Stationery according to claim 1, wherein said first transverse scission line is a perforate line.

20. Stationery according to any of the preceding claims wherein said second transverse separation line is completely through-penetrative of said detachable ply at least between said longitudinal lines of weakening.

* * * * *